US008249492B2

(12) United States Patent
Matsumoto

(10) Patent No.: US 8,249,492 B2
(45) Date of Patent: Aug. 21, 2012

(54) FIXING BELT, FIXING APPARATUS AND IMAGE FORMING APPARATUS

(75) Inventor: Hiroshi Matsumoto, Hachioji (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 308 days.

(21) Appl. No.: 12/633,086

(22) Filed: Dec. 8, 2009

(65) Prior Publication Data

US 2010/0150623 A1 Jun. 17, 2010

(30) Foreign Application Priority Data

Dec. 15, 2008 (JP) ..... 2008-318157

(51) Int. Cl.
*G03G 15/20* (2006.01)

(52) U.S. Cl. ..... 399/329

(58) Field of Classification Search ..... 399/320, 399/329

See application file for complete search history.

(56) References Cited

U.S. PATENT DOCUMENTS 7,860,441 B2 * 12/2010 Matsumoto ..... 399/329
2007/0217839 A1 * 9/2007 Moteki et al. ..... 399/329

FOREIGN PATENT DOCUMENTS

JP 200691182 4/2006
JP 2007-322471 12/2007

OTHER PUBLICATIONS

Japanese Office Action—Notice of Reasons for Refusal (4 pages) and English language translation thereof (5 pages), Mar. 28, 2011.

* cited by examiner

*Primary Examiner* — Walter L Lindsay, Jr.
*Assistant Examiner* — Frederick Wenderoth
(74) *Attorney, Agent, or Firm* — Lucas & Mercanti, LLP

(57) ABSTRACT

Provided is a fixing belt wherein the surface roughness of the inner peripheral surface of the fixing belt is designed with consideration given not only to the height of the protruding section and the depth of the recessed section but also to the expansion of the protruding section and recessed section in the lateral direction so that the contact resistance, hence, the sliding resistance can be reduced, and stable holding of the lubricant can be ensured. A fixing belt used in an image forming apparatus to fix a toner image on a recording material; wherein a wavy pattern which has a height of 3 to 5 μm at a pitch of 4 to 5 mm is formed on an inner peripheral surface, and a roughened structure which has a height of 3 to 4 μm at a pitch 0.1 mm is formed.

5 Claims, 3 Drawing Sheets

FIXING BELT, FIXING APPARATUS AND IMAGE FORMING APPARATUS

RELATED APPLICATION

The present application is based on Patent Application No. 2008-318157 filed at the Japan Patent Office on Dec. 15, 2008 and which is hereby incorporated herein in its entirety.

TECHNICAL FIELD

The present invention relates to a fixing belt characterized by easy holding of a lubricant and capability of reducing a sliding resistance, a fixing apparatus equipped with such a fixing belt, and an image forming apparatus provided with such a fixing apparatus.

BACKGROUND

In a photocopier, printer, fax machine and image forming apparatus using electrophotographic process such as a multi-functional peripheral including the functions of these devices, the latent image corresponding to a document is formed on a photoreceptor drum and toner is applied to this latent image, whereby the image is developed by toner. The developed toner image is transferred onto a recording material. After that, the toner image of the recording material is fixed and the sheet is ejected.

When a color image is formed, four latent images Y, M, C and K corresponding to document colors are formed on four photoreceptor drums, and four developed toner images are primarily transferred onto an endless intermediate transfer belt. After that, these images are transferred secondarily onto a recording material. The toner image transferred onto the recording material is fixed and the sheet is ejected.

One of the fixing apparatuses for fixing above-mentioned toner image is a heat roller fixing type fixing apparatus, wherein the recording material with the toner image transferred thereon is sandwiched in between and conveyed using the nip portion made up of a fixing roller incorporating a heating device such as a halogen heater, and a pressure roller for pressing the fixing roller, whereby the recording material is heated and pressed. This type of fixing apparatus has come into widespread use because of simple structure.

Incidentally, in such a fixing apparatus, a sufficient heat must be supplied to the toner and recording material in order to increase the speed. This requires the nip width to be increased. To increase the nip width, it would be necessary to increase the load of the pressure roller for applying pressure to the fixing roller, the thickness of the elastic layer made up of silicone rubber and others in the pressure roller or the diameters of two rollers.

However, if the load of the pressure roller or the thickness of the elastic layer has been increased, uneven nip width may result in the axial direction. This may cause uneven fixing and wrinkles of the recording material to be produced. Further, an increase of the roller diameter causes the fixing apparatus to be increased in size and the warming-up time to be prolonged.

One of the apparatuses disclosed to solve these problems is a fixing apparatus including:

a rotating fixing roller which contains an elastic layer formed of a silicone rubber and incorporates a heating device such as a halogen heater at the center;

an endless fixing belt driven and rotated by a fixing roller; and a pressure pad arranged on the inner peripheral surface side of the fixing belt, wherein the fixing belt is pressed toward the fixing roller by a pressure pad (e.g., Japanese Unexamined Patent Application Publication No. 2006-91182).

According to this fixing apparatus, the fixing belt pressed against the fixing roller by the pressure pad is subjected to elastic deformation, and a wider nip portion is formed between the fixing roller and fixing belt. This arrangement is capable of meeting high speed requirements, without the fixing apparatus being increased in size. Further, the heat capacity of the fixing belt is small. This feature reduces the warming-up time and saves energy.

In the fixing apparatus disclosed in the Japanese Unexamined Patent Application Publication No. 2006-91182, when the inner peripheral surface of a rotating fixing belt is made to slide along the fixed pressure pad, the sliding resistance will be increased. This may result in a reduction in the fixing image quality due to misalignment of a fixing belt, an increase in the power consumption of a motor for driving the fixing belt due to an increase in the drive torque of the fixing belt, damages of a speed reduction gear, abrasion on the inner peripheral surface of the fixing belt, or a similar trouble. Thus, to minimize the sliding resistance between the fixing belt and pressure pad, a sliding sheet made of low-friction material is arranged between the fixing belt and pressure pad. Further, a lubricant supply member for supplying a lubricant is provided, wherein this lubricant supply member is arranged in close contact with the inner peripheral surface of the fixing belt.

In addition, the inner peripheral surface of the fixing belt is formed into a rough surface. In this case, an increase in surface roughness on the inner peripheral surface of the fixing belt will reduce the contact area with the sliding sheet. This will lead to a reduction in the sliding resistance with the sliding sheet, and a friction noise is increased by contact between the fixing belt and sliding sheet. By contrast, if the surface roughness on the inner peripheral surface of the fixing belt is reduced, the friction noise can be reduced, but the effect of reducing the sliding resistance is also reduced.

In the fixing apparatus disclosed in the Japanese Unexamined Patent Application Publication No. 2006-91182, for the surface roughness value for the inner peripheral surface of the fixing belt, the percentage of the maximum peak height to the maximum valley depth is defined by a predetermined conditional expression. Further, the maximum height obtained by adding the maximum valley depth to the maximum peak height is also defined by a predetermined conditional expression, whereby both the sliding resistance and rubbing noise can be reduced at the same time.

In the meantime, the present inventors have made concentrated study efforts to study the relationship between the surface roughness of the inner peripheral surface of the fixing belt and reduction in the fixing belt drive torque, have found out the conditional expression of the surface roughness defined in the Japanese Unexamined Patent Application Publication No. 2006-91182 is not sufficient to reduce the drive torque. To be more specific, even if the measurement has successfully met the conditional expression of the Japanese Unexamined Patent Application Publication No. 2006-91182, the drive torque is sometime low and sometimes high, depending on the difference in the roughened structure on the surface. A positive means cannot be provided by defining the inner peripheral surface of fixing belt in above-mentioned manner, according to the findings by the present inventors.

To be more specific, above-mentioned conditional expression merely defines the height of the minute peak on the surface of the fixing belt, i.e., the height of the protruding section, and the depth of the valley, i.e., the depth of the recessed section. No consideration is given at all to the expansion of the protruding section and recessed section in the lateral direction. Thus, in the recessed section of minute depth, lubricant leaks from the recessed section by the surface tension. This makes it difficult to ensure positive holding of the lubricant. Thus, even when the conditional expression of the surface roughness on the inner peripheral surface of a fixing belt, positive holding of the lubricant is difficult when there are a great number of recessed sections of minute width. Drive torque cannot be reduced, according to the test conducted by the present inventors.

In view of the problems described above, it is an object of the present invention to provide a fixing belt wherein the surface roughness of the inner peripheral surface of the fixing belt is designed with consideration given not only to the height of the protruding section and the depth of the recessed section but also to the expansion of the protruding section and recessed section in the lateral direction so that the contact resistance, hence, the sliding resistance can be reduced, and stable holding of the lubricant can be ensured, whereby the drive torque of the fixing belt can be reduced; a fixing apparatus equipped with this fixing belt; and an image forming apparatus equipped with this fixing apparatus.

SUMMARY

The aspects of the present invention are any one of the bookbinding apparatus or the image forming system described as follows.

1. A fixing belt used in an image forming apparatus to fix a toner image on a recording material;

wherein a wavy pattern which has a height of 3 to 5 μm at a pitch of 4 to 5 mm is formed on an inner peripheral surface, and a roughened structure which has a height of 3 to 4 μm at a pitch 0.1 mm is formed.

2. A fixing apparatus comprising:

a rotating fixing roller containing a heating device;

wherein the fixing belt of the claim 1 is driven and rotated by the fixing roller;

a sliding sheet located on an inner peripheral surface side of the fixing belt;

a pressure device for pressing the fixing belt toward the fixing roller through the sliding sheet; and a lubricant supply device for supplying a lubricant to the inner peripheral surface of the fixing belt;

wherein the toner image on the recording material is fixed at a nip portion formed between the fixing roller and the fixing belt.

DESCRIPTION OF THE PREFERRED EMBODIMENT

The following describes the present invention with reference to the following embodiments, without the present invention being restricted by these embodiments.

Figure 1:
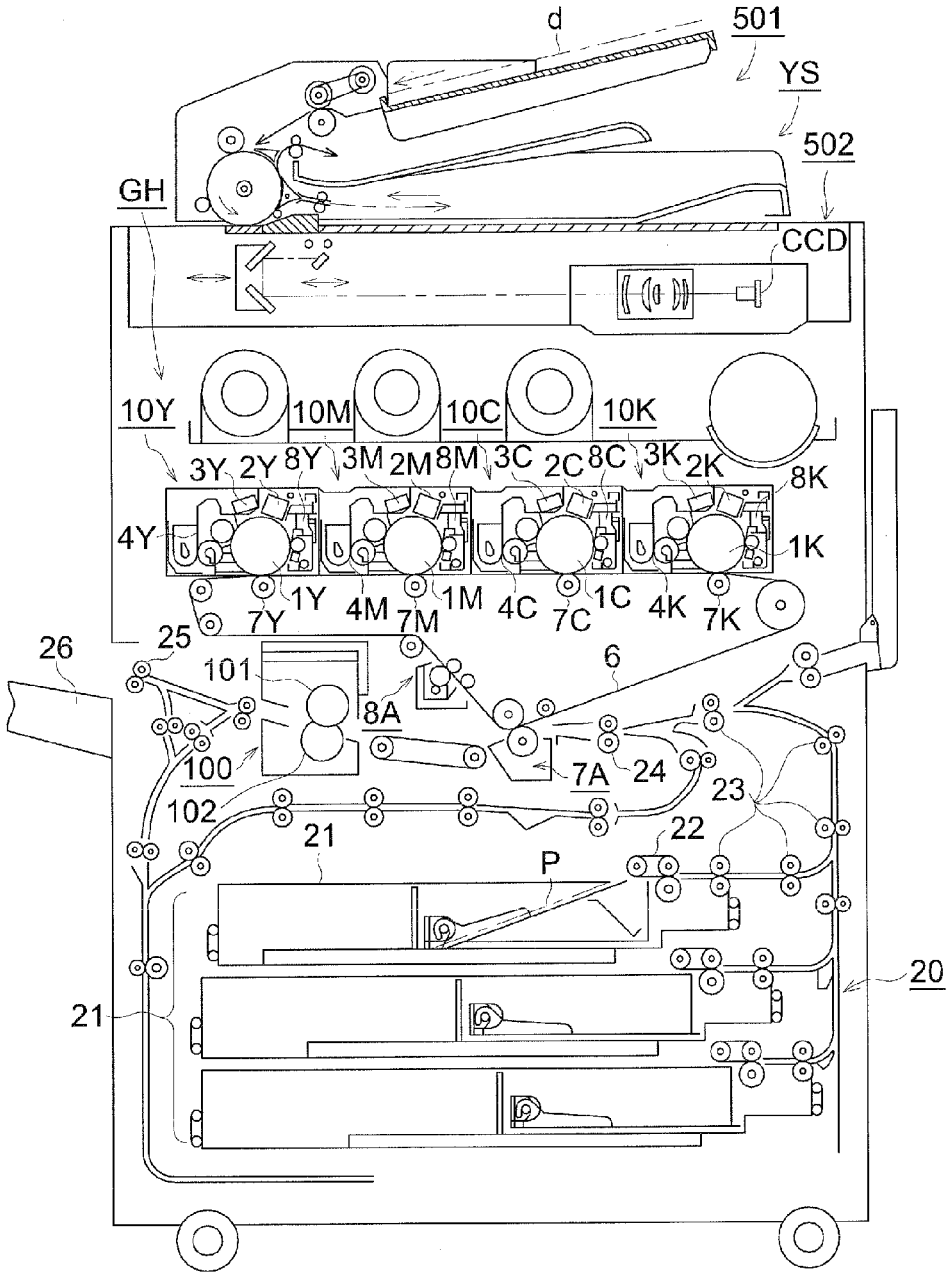
FIG. 1 is a schematic diagram showing an example of the image forming apparatus in the present invention.

In the first place, an example of the image forming apparatus in the present invention will be described with reference to the schematic diagram of FIG. 1.

This image forming apparatus includes an image reading apparatus YS, image forming section GH and others. The image forming section GH is called a tandem type color image forming apparatus, and includes a plurality of image forming units 10Y, 10M, 10C and 10K, intermediate transfer member 6, secondary transfer device 7A, fixing apparatus 100, sheet feed device 20 and others.

An image reading apparatus YS made up of an automatic document feeder 501 and a document image scanning/exposure apparatus 502 is installed on the upper portion of the image forming section GH. The document d placed on the document platen of the automatic document feeder 501 is conveyed by a conveyance device, and an image on one side or both sides of the document is subjected to scanning and exposure by the optical system of a document image scanning/exposure apparatus 502, and is read by a line image sensor CCD.

The image signal formed by photoelectric conversion of the line image sensor CCD is subjected to analog processing, analog-to-digital conversion, shading correction and image compression processing by an image processing section not illustrated. After that, the sheet is fed to the exposure devices 3Y, 3M, 3C and 3K.

The image forming unit 10Y for forming a yellow (Y) image includes a charging device 2Y, exposure device 3Y, development apparatus 4Y, primary transfer device 7Y and cleaning device 8Y located around the photoreceptor drum 1Y. The image forming unit 10M for forming a magenta (M) image includes a charging device 2M, exposure device 3M, development apparatus 4M, primary transfer device 7M and cleaning device 8M located around the photoreceptor drum 1M. The image forming unit 10C for forming a cyan (C) image includes a charging device 2C, exposure device 3C, development apparatus 4C, primary transfer device 7C and cleaning device 8C located around the photoreceptor drum 1C. The image forming unit 10K for forming a black (K) image includes a charging device 2K, exposure device 3K, development apparatus 4K, primary transfer device 7K and cleaning device 8K located around the photoreceptor drum 1K. The charging device 2Y with exposure device 3Y, charging device 2M with exposure device 3M, charging device 2C with exposure device 3C, and charging device 2K with exposure device 3K constitutes a latent image forming device.

The development apparatuses 4Y, 4M, 4C and 4K includes a two-component developer made up of small-diameter toners and carriers of yellow (Y), magenta (M), cyan (C) and black (K).

The intermediate transfer member 6 is wound and is rotatable supported by a plurality of rollers.

The fixing apparatus 100 heats and presses the toner image on a recording sheet P (recording material) and fixes the image using the nip portion formed between a fixing roller 101 incorporating a halogen heater, and a fixing belt 102.

The images of various colors formed by the image forming units 10Y, 10M, 10C and 10K are sequentially subjected to primary transfer onto the rotating intermediate transfer member 6 by primary transfer devices 7Y, 7M, 7C and 7K, whereby a toner image with color images superimposed one on top of another is formed.

The recording sheets P accommodated in a sheet feed tray 21 are separated from one another and are fed by the sheet feed roller 22 of a sheet feed device 20. The sheets P are supplied to the registration roller 24 at standstill through a plurality of sheet feed rollers 23. The sheets P are stopped once in this position. The registration roller 24 starts rotation at the every moment when there is a positional agreement between the leading edge of the sheet P and the toner image on the intermediate transfer member 6. Thus, the sheets P are supplied to the secondary transfer device 7A and the color image is secondarily transferred onto the recording sheet P. The recording sheet P with the color image transferred thereon is heated and pressed in the fixing apparatus 100, and the color toner image is fixed on the recording sheet P. After that, the sheet P is sandwiched by an ejection roller 25 and is placed on the sheet ejection tray 26 outside the machine.

In the meantime, after the color image has been transferred onto the recording sheet P by the secondary transfer device 7A, the recording sheets P are subjected to curvature separation by the intermediate transfer member 6. The remaining toner is removed from this intermediate transfer member 6 by the intermediate transfer member cleaning device 8A.

The above-mentioned description refers to the image forming apparatus for forming a color image. This description also applies to an image forming apparatus for forming a monochromatic image as well as an image forming apparatus wherein secondary transfer is not performed.

Figure 2:
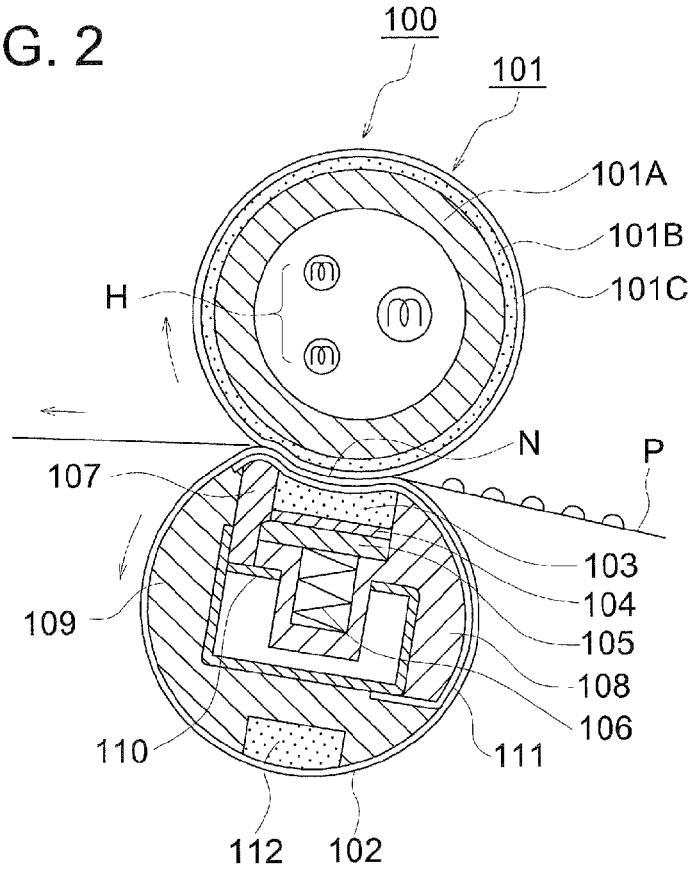
FIG. 2 is an enlarged cross sectional view showing FEN type fixing apparatus in the present invention.

The following describes an example of the fixing apparatus 100 in the present invention with reference to enlarged cross sectional view of FIG. 2. This fixing apparatus 100 is an FBN (Free Belt Nip) type fixing apparatus wherein the fixing belt 102 is not stretched to the roller.

The fixing roller 101 incorporates halogen heater (heating device) H at the center; as a cylindrical cored bar 101A made of aluminum and iron; an elastic layer 101B covering a cylindrical cored bar 101A and made of highly heat-resistant silicone rubber; and a mold release layer 101C covering an elastic layer 101B and made of a fluorine resin such as PFA (perfluoroalkoxy) or PTFE (polytetrafluoroethylene).

The fixing belt 102 an endless belt made up of a substrate of polyimide, and a mold release layer of PFA or PTFE for covering the outer surface of the substrate.

The pressure pad 103 is made of a silicone rubber having a JISA hardness of about 10 degrees. Together with a base sheet metal 104 of stainless steel and a base member 105 of heat resistant resin, the pressure pad 103 is held by a holder 108 of heat resistant resin. Further, a compression spring 106 is arranged on the back of the base member 105. The pressure pad 103, base sheet metal 104, base member 105 and compression spring 106 correspond to the pressure device.

To improve the separability of the recording sheet P to which fixing process has been applied, the separation member 107 is arranged downstream in the direction of the recording sheet P being conveyed with reference to the pressure pad 103. The separation member 107 is made of a heat resistant resin such as polyphenylene sulfide (PPS), polyimide and polyester and polyimide, or a metal such as aluminum. The separation member 107 has the leading edge shaped like an arc of large curvature. Further, a metallic frame 110 for holding the holder 108 is arranged at the center.

The sliding sheet 111 is formed by coating a glass fiber sheet with fluorine resin (PTFE) and Teflon (registered trademark), and has a small friction resistance. The sliding sheet 111 is located between the fixing belt 102 and pressure pad 103, and between the fixing belt 102 and separation member 107. One end of the sliding sheet 111 is fixed to the frame 110.

The guide member 109 is located on the inner peripheral surface side of the fixing belt 102, and is used to guide the fixing belt 102 wherein a sliding sheet 111 is not provided.

The oil pad 112 as a lubricant supply device includes a sponge. Impregnated with a lubricant made of silicone oil and others, the oil pad 112 is held by the guide member 109, and is pressed against the inner peripheral surface of the fixing belt 102.

In the fixing apparatus 100 having the above-mentioned configuration, the fixing roller 101 heated by a halogen heater H and driven by an unillustrated drive device rotates in the clockwise direction. Further, the pressure pad 103 is pressed by the compression spring 106 through the base sheet metal 104 and base member 105. The pressure pad 103 presses the fixing belt 102 against the fixing roller 101 through the sliding sheet 111, and is subjected to elastic deformation. Further, the separation member 107 presses the fixing belt 102 against the fixing roller 101 through the sliding sheet 111 so that the fixing roller 101 is subjected to elastic deformation.

Thus, the fixing belt 102 in the free state without being stretched to the roller is rotated in the counterclockwise direction by the rotation of the fixing roller 101, and slides along the sliding sheet 111 and guide member 109. The fixing belt 102 is pressed against the fixing roller 101 by a pressure pad 103, and is subjected to elastic deformation together with the pressure pad 103. This causes a wide nip portion N to be formed between the fixing belt 102 and fixing roller 101. The toner image unfixed on the recording sheet P having been conveyed is heated and pressed by the nip portion N, whereby the toner image is fixed thereon.

The separation member 107 presses the fixing belt 102 against the fixing roller 101 through the sliding sheet 111 so that the elastic layer 101E of the fixing roller 101 and the mold release layer 101C are subjected to elastic deformation to form a large convex having a greater curvature. Thus, the recording sheet P fixed at the nip portion N can be positively separated and removed from the fixing roller 101 without a separation claw being used.

The inner peripheral surface of the fixing belt 102 slides along the sliding sheet 111 during the rotation. Since the sliding sheet 111 has a small friction coefficient, the sliding resistance between the two is small. Further, since silicone oil as a lubricant is supplied to the inner peripheral surface of the fixing belt 102 from the oil pad 112, the sliding resistance is further reduced.

However, in an actual fixing apparatus, the fixing belt is rotated at a low torque. Thus, the above-mentioned structure is insufficient. Preferably, minute roughened structures are formed on the inner peripheral surface of the fixing belt, and the contact area to the sliding sheet or the like is reduced, whereby the sliding resistance is reduced.

Further, to ensure that the fixing belt rotates at a low torque for a long period of time, the lubricant must be held stably by the inner peripheral surface of the fixing belt 102. However, when minute roughened structures are formed on the inner peripheral surface of the fixing belt without any other measures being taken, the lubricant may overflow from recessed section due to surface tension. This makes it difficult to ensure stable supply of lubricant.

To solve this problem, the inner peripheral surface of the fixing belt is provided with wavy pattern and minute roughened structures. This arrangement reduces the contact area of the fixing belt and reduces the sliding resistance. At the same time, stable holding of the lubricant is ensured by recessed section of the wavy pattern.

Figure 3:
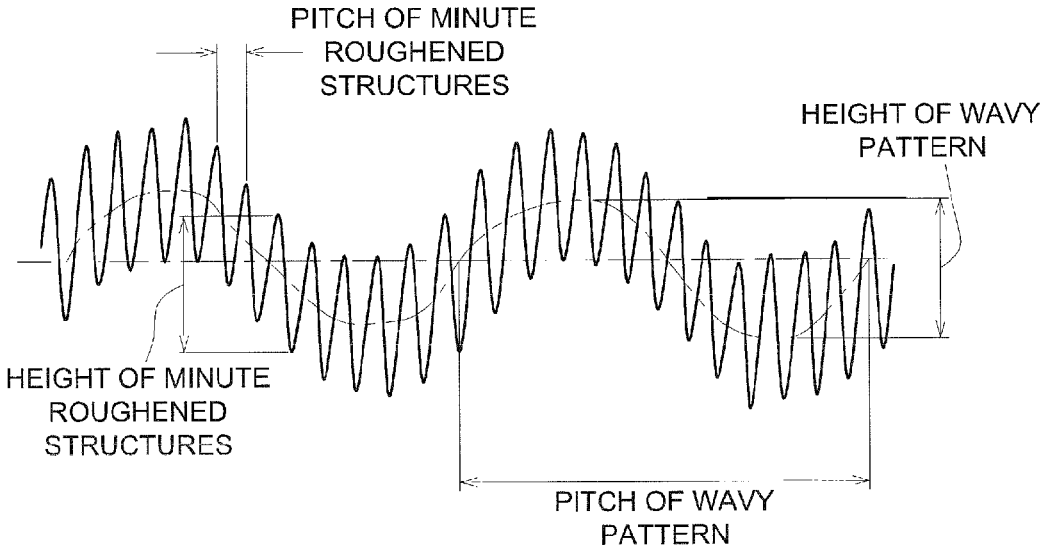
FIG. 3 is a diagram defining the pitch and height of the wavy pattern, and the pitch and height of minute roughened structures.

FIG. 3 defines the pitch and height of the wavy pattern and the pitch and height of the minute roughened structure.

It can be estimated that stable holding of the lubricant and reduction of the sliding resistance will not be ensured if the size of wavy pattern and minute roughened structures (hereinafter referred to as "minute roughened structure") is excessive or insufficient. This is because of the following reasons.

If the pitch of the minute roughened structure is excessively small, the contact area cannot be reduced, hence, the sliding resistance is not reduced.

If the pitch of the minute roughened structure is excessively large, crushing will occur at the nip portion. Thus, the contact area cannot be reduced, hence, the sliding resistance is not reduced. Further, the width of the protruding section will be insufficient and the height will be excessive.

If the height of the minute roughened structure is insufficient, the effect of roughened structures cannot be gained. The contact area cannot be reduced, hence, the sliding resistance is not reduced. Particularly when the fixing belt has been worn, the recessed section will be clogged with the abrasion dust, whereby durability problem will arise.

If the height of the minute roughened structure is excessive, crushing will occur at the nip portion. Thus, the contact area cannot be reduced, hence, the sliding resistance is not reduced. Further, the width of the protruding section will be insufficient and the height will be excessive.

If the pitch of the wavy pattern is insufficient, positive holding of the lubricant will be difficult.

If the pitch of the wavy pattern is excessive, positive holding of the lubricant will also be difficult.

If the height of the wavy pattern is insufficient, positive holding of the lubricant will be difficult.

If the height of the wavy pattern is excessive, the lubrication effect cannot be easily obtained without using a great amount of lubricant. Thus, torque cannot be reduced. To be more specific, generally, the optimum lubrication effect is obtained when the lubricant is 1 to 10 μm thick. If the lubricant is thicker, lubrication is carried out while shearing occurs in the oil film. This does not contribute to reduction of torque.

The following test was conducted to obtain the wavy pattern provided on the fixing belt and the maximum values of the pitch and height of the minute roughened structure:

(1) Test Conditions

Fixing apparatus: structure as shown in FIG. 2

Fixing belt: inner diameter of 35 mm

Fixing roller: outer diameter of 40 mm

Fixing temperature: 190 degrees Celsius

Nip pressure: 490N

Lubricant: Dimethylsilicone oil, viscosity 300 cs (2) Test Details

As illustrated in Table 1, L9 orthogonal test was conducted on four factors at three levels.

TABLE 1

| Factor | | Level 1 | Level 2 | Level 3 |
|---|---|---|---|---|
| Wavy pattern | Pitch (mm) | 3 | 5 | 7 |
| | Height (μm) | 1 | 4 | 7 |
| Minute roughened structure | Pitch (mm) | 0.1 | 0.2 | 0.3 |
| | Height (μm) | 1 | 4 | 7 |

Table 2 shows the result of the test.

TABLE 2

| | | ** 1 | ** 2 | ** 3 | ** 4 | ** 5 | ** 6 | ** 7 | ** 8 | ** 9 |
|---|---|---|---|---|---|---|---|---|---|---|
| Wavy pattern | Pitch (mm) | 3 | 3 | 3 | 5 | 5 | 5 | 7 | 7 | 7 |
| | Height (μm) | 1 | 4 | 7 | 1 | 4 | 7 | 1 | 4 | 7 |
| Minute roughened structure | Pitch (mm) | 0.1 | 0.2 | 0.3 | 0.2 | 0.3 | 0.1 | 0.3 | 0.1 | 0.2 |
| | Height (μm) | 1 | 4 | 7 | 7 | 1 | 4 | 4 | 7 | 1 |
| Torque | Measurement | Great through intermediate | Intermediate through small | Great | Intermediate | Intermediate through small | Small | Intermediate | Great | Great |
| | Variation range | Small | Intermediate | Great | Intermediate | Intermediate | Small | Great | Intermediate through small | Great |
| | Transitional trend | Intermediate | Small | Great | Intermediate | Small | Great | Intermediate | Small | Great |

** Condition

In Table 2, terms "Great", "Intermediate" and "Small" for torque are defined as follows:

Measurement

Great: 5 kgcm or more

Intermediate: 4 kgcm or more to 5 kgcm exclusive

Small: below 4 kgcm

Variation Range

Variation in Measurements in Initial State

Great: 25% or more

Intermediate: 15% or more to 25% exclusive

Small: below 15%

Transitional Trend

Increase in torque for the time of rotation equivalent to 150 kc (kilo copy) in terms of the fixed number of sheets Great: 25% or more Intermediate: 15% or more to 25% exclusive Small: below 15%

It was revealed that, when the wavy pattern had pitches of 3 mm and 7 mm, a great torque measurement was registered. When the wavy pattern had heights of 1 μm and 7 μm there was a chronological increase of torque. When the minute roughened structure had heights of 1 μm and 7 μm, a great torque measurement was obtained.

Thus, as shown in Table 3, the levels were changed for the pitch and height of the wavy pattern, and the height of the minute roughened structure, and a second orthogonal test was conducted under the same conditions as those of the first test.

TABLE 3

| Factor | | Level 1 | Level 2 | Level 3 |
|---|---|---|---|---|
| Wavy pattern | Pitch (mm) | 4 | 5 | 6 |
| | Height (μm) | 2 | 4 | 6 |
| Minute roughened structure | Pitch (mm) | 0.1 | 0.2 | 0.3 |
| | Height (μm) | 2 | 4 | 6 |

Table 4 shows the result of the test.

TABLE 4

| | | ** 1 | ** 2 | ** 3 | ** 4 | ** 5 | ** 6 | ** 7 | ** 8 | ** 9 |
|---|---|---|---|---|---|---|---|---|---|---|
| Wavy pattern | Pitch (mm) | 4 | 4 | 4 | 5 | 5 | 5 | 6 | 6 | 6 |
| | Height (μm) | 2 | 4 | 6 | 2 | 4 | 6 | 2 | 4 | 6 |
| Minute roughened structure | Pitch (mm) | 0.1 | 0.2 | 0.3 | 0.2 | 0.3 | 0.1 | 0.3 | 0.1 | 0.2 |
| | Height (μm) | 2 | 4 | 6 | 6 | 2 | 4 | 4 | 6 | 2 |
| Torque | Measurement | Intermediate through small | Small | Intermediate | Intermediate | Intermediate through small | Small | Intermediate | Great | Great |
| | Variation range | Small | Intermediate through small | Intermediate | Intermediate | Intermediate | Small | Great | Intermediate through small | Great through intermediate |
| | Transitional trend | Intermediate | Small | Great | Intermediate | Small | Great | Intermediate | Small | Great |

** Condition

It was revealed that, when the wavy pattern had heights of 2 μm and 6 μm, there was a chronological increase of torque. When the minute roughened structure had heights of 2 μm and 6 μm, the torque measurement was not reduced.

Thus, as shown in Table 5, the levels were changed for the height of the wavy pattern, and the height of the minute roughened structure, and a third orthogonal test was conducted under the same conditions as those of the first test.

TABLE 5

| Factor | | Level 1 | Level 2 | Level 3 |
|---|---|---|---|---|
| Wavy pattern | Pitch (mm) | 4 | 5 | 6 |
| | Height (μm) | 3 | 4 | 5 |
| Minute roughened structure | Pitch (mm) | 0.1 | 0.2 | 0.3 |
| | Height (μm) | 3 | 4 | 5 |

Table 6 shows the result of the test.

TABLE 6

| | | ** 1 | ** 2 | ** 3 | ** 4 | ** 5 | ** 6 | ** 7 | ** 8 | ** 9 |
|---|---|---|---|---|---|---|---|---|---|---|
| Wavy pattern | Pitch (mm) | 4 | 4 | 4 | 5 | 5 | 5 | 6 | 6 | 6 |
| | Height (μm) | 3 | 4 | 5 | 3 | 4 | 5 | 3 | 4 | 5 |
| Minute roughened structure | Pitch (mm) | 0.1 | 0.2 | 0.3 | 0.2 | 0.3 | 0.1 | 0.3 | 0.1 | 0.2 |
| | Height (μm) | 3 | 4 | 5 | 5 | 3 | 4 | 4 | 5 | 3 |
| Torque | Measurement | Small | Small | Small | Small | Small | Small | Intermediate | Intermediate | Intermediate |
| | Variation range | Small | Intermediate through small | Intermediate | Intermediate | Intermediate | Small | Great | Intermediate through small | Great through intermediate |
| | Transitional trend | Small | Small | Small | Small | Small | Small | Small | Small | Small |

** Condition

It was revealed that, when the wavy pattern had a pitch of 4 to 5 mm and a height of 3 to 5 μm, and the minute roughened structure had a pitch of 0.1 mm and a height of 3 to 4 μm, excellent results were registered for all the torque measurement, variation range and transitional trend.

It should be noted that these are very small values, and include a measurement error of about 20%.

(3) Considerations

As illustrated above, the inner peripheral surface of the fixing belt is provided with wavy patterns and minute roughened structures, and their numerical values are defined. This arrangement ensures a long-term stability of the drive torque of the fixing belt, with the result that the torque is reduced.

Holding of the lubricant on the inner peripheral surface of the fixing belt depends only on the shape of the surface of the fixing belt, and is not affected by the material of the fixing belt and sliding sheet, the width of the fixing belt (contact area), contact pressure, rotational speed or other structural factors of the fixing apparatus. Thus, the pitches and heights of the wavy pattern and minute roughened structure obtained from above-mentioned tests are universally applicable to any type of fixing belt.

Further, use of a lubricant of extremely high or low viscosity will surely affect the holding capacity of the belt. However, the viscosity of the lubricant used for sliding movement of the fixing belt of the fixing apparatus does not exceed 1000 cs, and there is no much difference. Even if there is a slight change in the viscosity depending on the type of the lubricant of this level, the data on the holding capacity is not affected.

It should be noted that the fixing apparatus using the fixing belt of the present invention is not restricted to the FBN type fixing apparatus wherein the fixing belt of FIG. 2 is not stretched to the roller. The fixing belt of the present invention is applicable to the fixing apparatus wherein the fixing belt is stretched to the roller.

Figure 4:
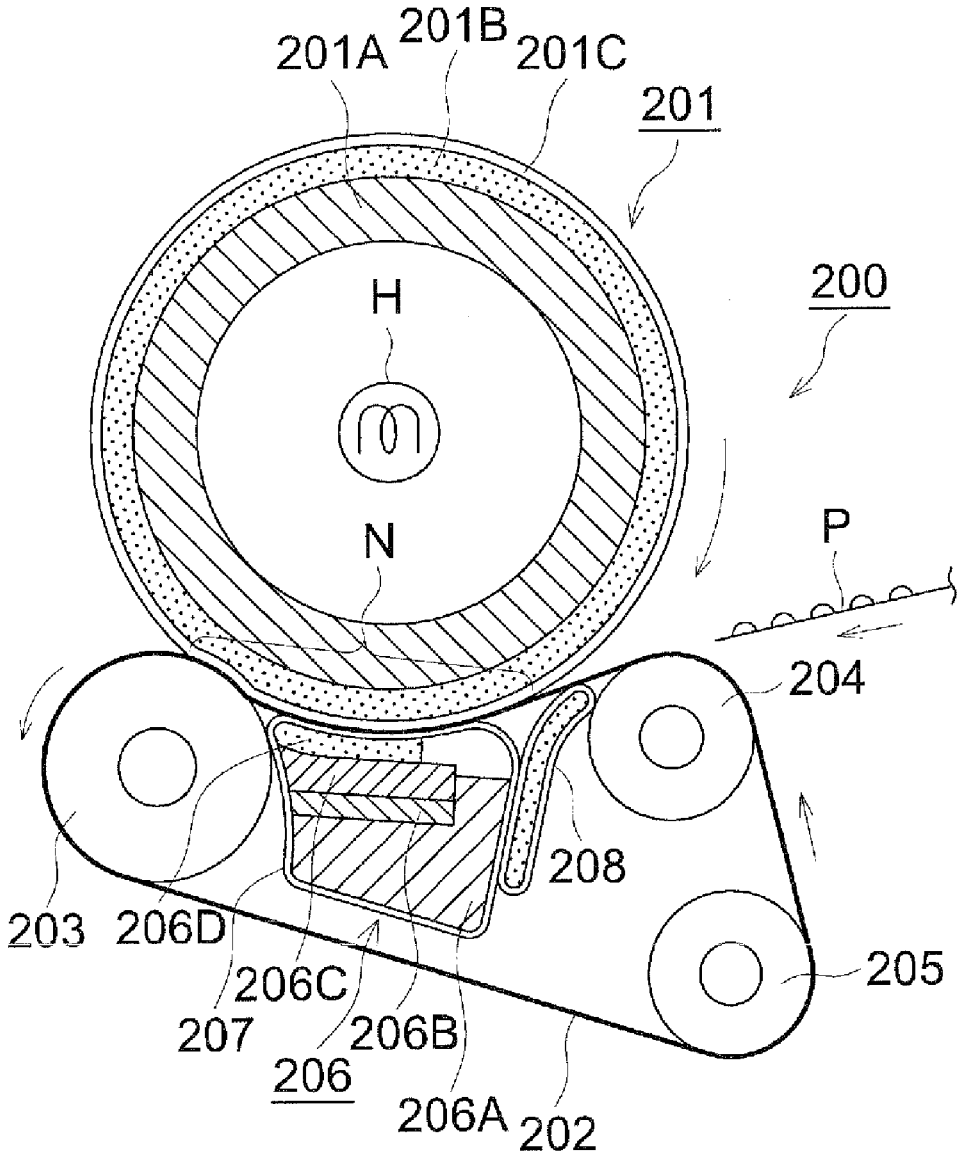
FIG. 4 is an enlarged cross sectional view of the fixing apparatus with a belt stretched thereto in the present invention.

Referring to FIG. 4, the following describes an example of such a fixing apparatus.

The fixing apparatus 200 of FIG. 4 mainly includes a rotating fixing roller 201; an endless fixing belt 202 rotated in a state pressed against the fixing roller 201; and a pressure device 206 for pressing the fixing belt 202 toward the fixing roller 201 from the inner peripheral surface side. The nip portion N formed between the fixing roller 201 and fixing belt 202 is used to fix the toner image on the recording sheet P.

The fixing roller 201 incorporates a halogen heater (heating device) H in the center. The fixing roller 201 also includes a cylindrical cored bar 201A made of a metal such as aluminum or stainless steel; an elastic layer 201B covering the cylindrical cored bar 201A and made of heat-resistant silicone rubber; and a surface layer 201C covering the elastic layer 201B and made of a PFA (perfluoro alkoxy ethylene) tube.

The fixing belt 202 is an endless belt including a substrate made of polyimide, and a surface layer covering this substrate and made of PFA and others. The inner peripheral surface of the fixing belt 202 is provided with the above-mentioned wavy pattern and minute roughened structure.

The fixing belt 202 is stretched to the pressure roller 203, inlet roller 204 and steering roller 205.

The pressure roller 203 is arranged on the outlet side of the nip portion. N and is used to press the fixing belt 202 against the fixing roller 201.

The inlet roller 204 is arranged on the inlet side of the nip portion N, and ensures that the fixing belt 202 located between the inlet roller 204 and pressure roller 203 is pressed against the fixing roller 201, without the fixing belt 202 being pressed directly against the fixing roller 201. Thus, a long nip portion N is formed in the direction wherein the recording sheet P is conveyed.

The steering roller 205 has an unillustrated mechanism that changes the parallelism and twist of the pressure roller 203 and inlet roller 204, and corrects the misalignment of the fixing belt 202 across the width.

The pressure roller 203, inlet roller 204 and steering roller 205 are made of such a metal as stainless steel.

The pressure device 206 is made of a holder 206A, shim 206B, supporting plate 206C, pressure pad 206D and sliding sheet 207.

The holder 206A is made of stainless steel. A shim 206B of heat resistant resin, a supporting plate 206C of stainless steel, a pressure pad 206D of silicone rubber are placed on the holder 206A sequentially in that order. The unillustrated compression spring presses the shim 206B. Then the fixing belt 202 is pressed against the fixing roller 201 through the pressure pad 206D.

The sliding sheet 207 is made of a glass fiber sheet coated with a fluorine resin, and is used to cover the periphery of the members ranging from the holder 206A to the pressure pad 206D. When the sliding sheet 207 of lower friction coefficient is provided, the pressure pad 206D of higher friction coefficient is prevented from contacting the fixing belt 202.

The lubricant supply device 208 is made of the felt impregnated with silicone oil or others which is covered with a porous resin sheet. Sliding along the inner peripheral surface of the fixing belt 202, the lubricant supply device 208 applies the lubricant to the inner peripheral surface.

As described above, in the fixing apparatus 200, the fixing roller 201 heated by the halogen heater H and driven by the unillustrated drive apparatus is rotated in the clockwise direction. The pressure roller 203 and pressure device 206 are pressed against each other, as described above. The pressure roller 203 and pressure pad 206D presses the fixing belt 202 against the fixing roller 201. Thus, a wide nip portion N is formed between the fixing roller 201 and fixing belt 202. Further, the fixing belt 202 is rotated in the counterclockwise direction by the rotation of the fixing roller 201. Thus, when the recording sheet P with the toner image transferred thereon is conveyed, the sheet P is sandwiched by the nip portion N, and is heated and pressed, whereby fixing is performed.

The pressure roller 203 applies pressure in such a way that the fixing belt 202 penetrates into the fixing roller 201, and the elastic layer 201B is subjected to elastic deformation. Accordingly, the recording sheet P wherein fixing has been performed is ejected, partly forming a large curvature, and is positively separated from the fixing roller 201.

With the rotation of the fixing belt 202, the lubricant supply device 208 applies lubricant to the inner peripheral surface of the fixing belt 202. Thus, the fixing belt 202 slides smoothly along the sliding sheet 207.

Incidentally, to form a wavy pattern and minute roughened structure on the fixing belt as mentioned above, the die core is provided with blasting, and the resulting pattern is transferred onto the inner peripheral surface of the fixing belt. In the core blasting operation, large-diameter particles made up of iron particles and glass particles are blasted to form a wavy pattern. After that, small-diameter particles are blasted to form minute roughened structures.

According to the above-mentioned embodiments, the surface roughness on the inner peripheral surface of the fixing belt is determined with consideration given not only to the height of the protruding section and the depth of the recessed section but also to the expansion of the protruding section and recessed section in the lateral direction. This arrangement reduces the contact resistance and sliding resistance and ensures stable holding of the lubricant, with the result that positive reduction in the drive torque of the fixing belt is ensured.

What is claimed is:

1. A fixing belt used in an image forming apparatus to fix a toner image on a recording material comprising:

a wavy pattern having a height of 3 to 5 μm at a pitch of 4 to 5 mm formed on an inner peripheral surface of the fixing belt, and a roughened structure having a height of 3 to 4 μm at a pitch 0.1 mm formed on the inner peripheral surface of the fixing belt.

2. A fixing apparatus comprising:

a rotating fixing roller containing a heating device;

the fixing belt of claim 1 driven and rotated by the fixing roller;

a sliding sheet located on an inner peripheral surface side of the fixing belt;

a pressure device for pressing the fixing belt toward the fixing roller through the sliding sheet; and a lubricant supply device for supplying a lubricant to the inner peripheral surface of the fixing belt;

wherein the toner image on the recording material is fixed at a nip portion formed between the fixing roller and the fixing belt.

3. The fixing apparatus of claim 2 wherein the fixing belt is not stretched by a roller.

4. The fixing apparatus of claim 2 wherein the fixing belt is stretched by a plurality of rollers.

5. An image forming apparatus comprising:

the fixing apparatus of claim 2.

* * * * *